US012297767B2

(12) United States Patent
Kennedy et al.

(10) Patent No.: US 12,297,767 B2
(45) Date of Patent: May 13, 2025

(54) SYSTEMS AND METHODS FOR MULTI-CORE RADIATORS

(71) Applicant: Caterpillar Inc., Peoria, IL (US)

(72) Inventors: Joseph L. Kennedy, Zionsville, IN (US); Bradley Paul Wrage, Pekin, IL (US); Dongming Tan, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 31 days.

(21) Appl. No.: 18/136,640

(22) Filed: Apr. 19, 2023

(65) Prior Publication Data

US 2024/0352885 A1 Oct. 24, 2024

(51) Int. Cl.

*F01P 7/16* (2006.01)
*F01P 7/04* (2006.01)
*F01P 7/14* (2006.01)

(52) U.S. Cl.

CPC ..... *F01P 7/165* (2013.01); *F01P 7/04* (2013.01); *F01P 2007/146* (2013.01); *F01P 2025/36* (2013.01)

(58) Field of Classification Search

CPC ..... F01P 7/165; F01P 7/04; F01P 2007/146; F01P 2025/36
USPC ..... 123/41.1
See application file for complete search history.

(56) References Cited

U.S. PATENT DOCUMENTS 4,236,492 A * 12/1980 Tholen ..... F02B 29/0431 123/563
5,353,757 A * 10/1994 Susa ..... F28F 27/02 123/41.31
5,669,338 A * 9/1997 Pribble ..... F01P 7/165 123/41.31
6,651,761 B1 * 11/2003 Hrovat ..... B60L 15/20 165/41
7,397,354 B1 * 7/2008 Easton ..... F01P 11/18 123/41.15
8,869,523 B2 * 10/2014 Chadwick ..... F01P 7/044 60/490
11,060,442 B2 * 7/2021 Jeong ..... F01P 7/164
(Continued)

FOREIGN PATENT DOCUMENTS

EP 4001713 5/2022
GB 2216249 A * 10/1989 ..... F28F 27/02
(Continued)

*Primary Examiner* — Hung Q Nguyen
*Assistant Examiner* — Anthony Donald Taylor, Jr.
(74) *Attorney, Agent, or Firm* — Schwegman Lundberg & Woessner, P.A.

(57) ABSTRACT

A method of controlling cooling fluid flow through a radiator system having multiple radiator cores comprises flowing cooling fluid through the radiator system, the radiator system comprising a first radiator core and a second radiator core, sensing a first temperature of ambient air, comparing the first temperature to a first threshold temperature and reducing flow through the first radiator core if the first temperature is below the first threshold temperature. The first radiator core has a first valve, and the second radiator core can have a second valve. The first valve can be opened to allow for parallel flow of cooling fluid through the first radiator core and the second radiator core between an inlet manifold and an outlet manifold and closed to interrupt flow of cooing fluid through the first radiator core between the inlet manifold and the outlet manifold.

20 Claims, 5 Drawing Sheets

(56) References Cited

U.S. PATENT DOCUMENTS

| | | | | |
|---|---|---|---|---|
| 2003/0079698 | A1* | 5/2003 | Morgan | F01P 7/048<br>123/41.1 |
| 2016/0290216 | A1* | 10/2016 | Katragadda | F01P 9/00 |
| 2021/0046848 | A1* | 2/2021 | Bellino | H01M 10/625 |

FOREIGN PATENT DOCUMENTS

| | | | | |
|---|---|---|---|---|
| GB | 2144015 | A2 * | 1/2010 | F24D 19/0012 |
| KR | 19980031485 | | 7/1998 | |

* cited by examiner

SYSTEMS AND METHODS FOR MULTI-CORE RADIATORS

TECHNICAL FIELD

The present disclosure relates generally, but not by way of limitation, to radiator systems that can be used with internal combustion engines or other heat generating systems. More particularly, the present disclosure relates to radiator systems and methods for operating radiator systems in cold ambient temperatures.

BACKGROUND

Radiator systems are used to disperse heat generated in an internal combustion engine to the ambient air. Typical radiator systems circulate a cooling fluid through internal passages of the internal combustion engine to absorb heat from metal of an engine block and then pass the cooling fluid through a radiator core where the cooling fluid can release the heat to the atmosphere, thereby cooling the cooling fluid. The design point for typical radiator system is approximately 35° C. or higher in order to provide adequate cooling in the hottest operating temperatures. At a more typical ambient operating temperature of approximately 25° C., radiator temperatures can reach an operating range of approximately 80° C. to approximately 85° C. However, many internal combustion engines can be used in ambient operating temperatures that drop well below 0° C., such as haul trucks or "dump trucks" used in mining operations in arctic climates of North America and Asia. The large temperature differentials between extremely cold ambient temperatures and the operating temperatures can induce thermal stress in components of the radiator system.

Some radiator systems utilize multiple radiator cores. For example, radiator systems used in conjunction with internal combustion engines that have large displacements have a correspondingly high volumetric capacity for the cooling fluid. However, due to manufacturing constrains or packaging considerations, a single, large radiator core is sometimes not used. As such, multiple radiator cores can be used together to provide desired cooling levels.

Publication No. KR 1998-0031485 A to Bae Ju-sik is titled "Variable Radiator."

SUMMARY OF THE INVENTION

A radiator system for cooling an internal combustion engine can comprise a first radiator core having a first inlet and a first outlet, a second radiator core having a second inlet and a second outlet, an inlet manifold connected to the first inlet and the second inlet, an outlet manifold connected to the first outlet and the second outlet and a first valve positioned to control flow through the first radiator core, wherein the first valve can be opened to allow for parallel flow of cooling fluid through the first radiator core and the second radiator core between the inlet manifold and the outlet manifold and closed to interrupt flow of cooing fluid through the first radiator core between the inlet manifold and the outlet manifold.

A method of controlling cooling fluid flow through a radiator system having multiple radiator cores can comprise flowing cooling fluid through the radiator system, the radiator system comprising a first radiator core and a second radiator core, sensing a first temperature of ambient air, comparing the first temperature to a first threshold temperature and reducing flow through the first radiator core if the first temperature is below the first threshold temperature.

DETAILED DESCRIPTION

Figure 1:
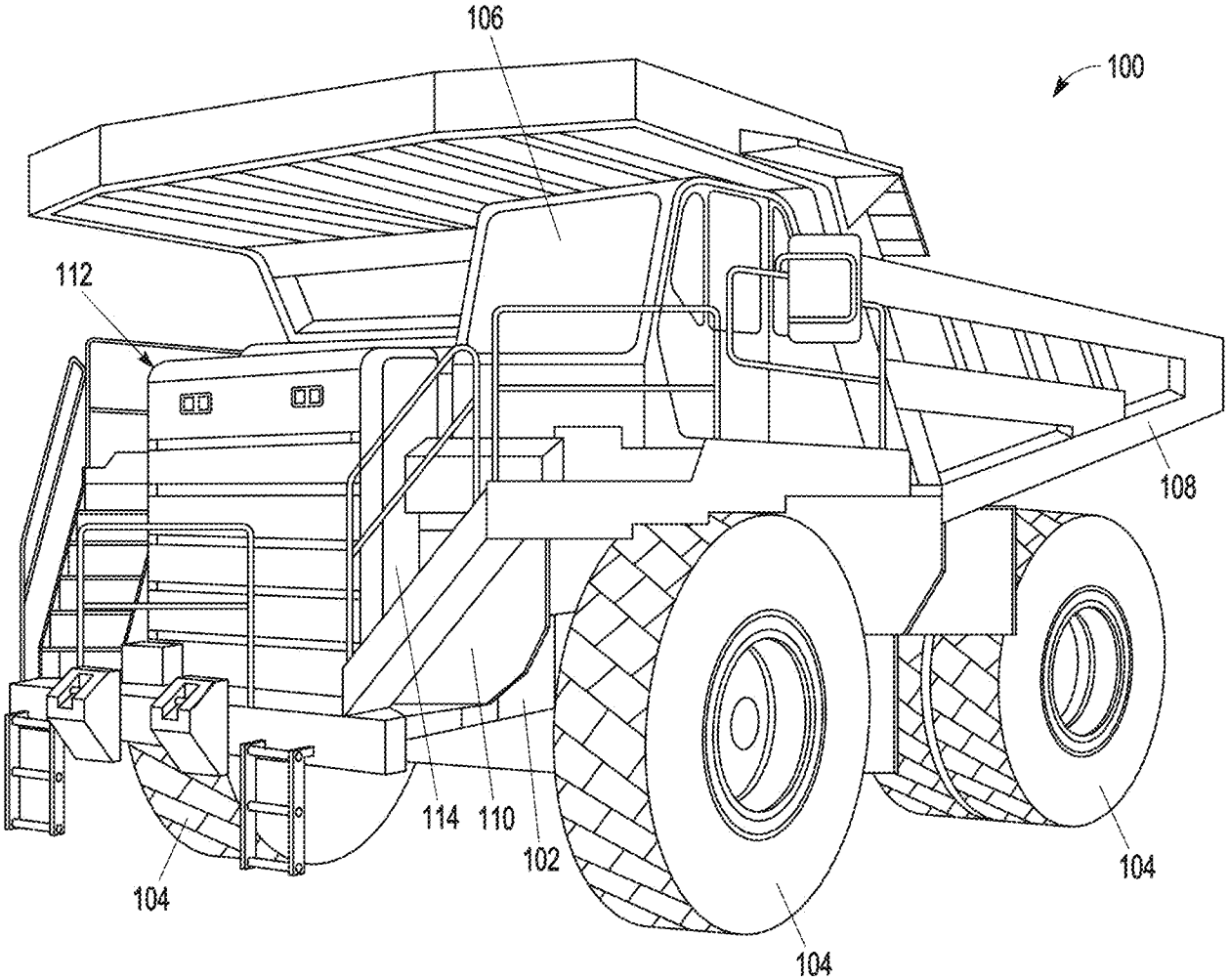
FIG. 1 is a perspective view of a haul truck comprising a radiator system of the present disclosure.

FIG. 1 is a perspective view of haul truck 100 comprising frame 102, wheels 104, operator station 106, dump box 108, engine compartment 110 and radiator system 112 of the present disclosure. FIG. 1 illustrates an example of a work machine comprising a haul truck. However, the radiator systems and methods of the present disclosure can be used with other work machines or vehicles. In additional examples, the radiator systems and methods of the present disclosure can be used with other systems utilizing radiator cores, such as power generation systems.

Wheels 104 can be rotatably mounted to frame 102. In examples, wheels 104 can comprise pneumatic tires. A power plant, such as an internal combustion engine, can be located within engine compartment 110 and can be used to generate rotational shaft power to provide mechanical input to wheels 104. As such, wheels 104 can provide motive force to haul truck 100. In additional examples, wheels 104 can be replaced by a track system.

Radiator system 112 can be connected to the power plant to provide cooling fluid to components that are heated as a result of an internal combustion process. Radiator system 112 can comprise housing 114 located on an exterior portion of frame 102 or operator station 106 to allow radiator cores within housing 114 to interact with ambient air. As discussed with reference to FIG. 2, cooling fluid lines can extend between housing 114 and engine compartment 110 to circulate cooling fluid.

Dump box 108 can be configured to receive a load of material, such as earth, dirt, rock, gravel and other mining related natural resources. At a mining site, dump box 108 can be loaded with material for transporting to a processing center, refinery or the like. The operator can activate controls within operator station 106 to cause rotation of dump box 108 to unload the materials, as is known in the art.

An operator can be situated in operator station 106 to control operation of the power plant, wheels 104, dump box 108 and radiator system 112. As such, the operator can steer wheels 104 with a steering wheel and control fuel injection to the power plant with an accelerator pedal to drive haul truck 100 to a mining site. In various examples of the present disclosure, an operator within operator station 106 can manually or electrically operate valves of radiator system 112 to control cooling operations thereof.

Figure 3:
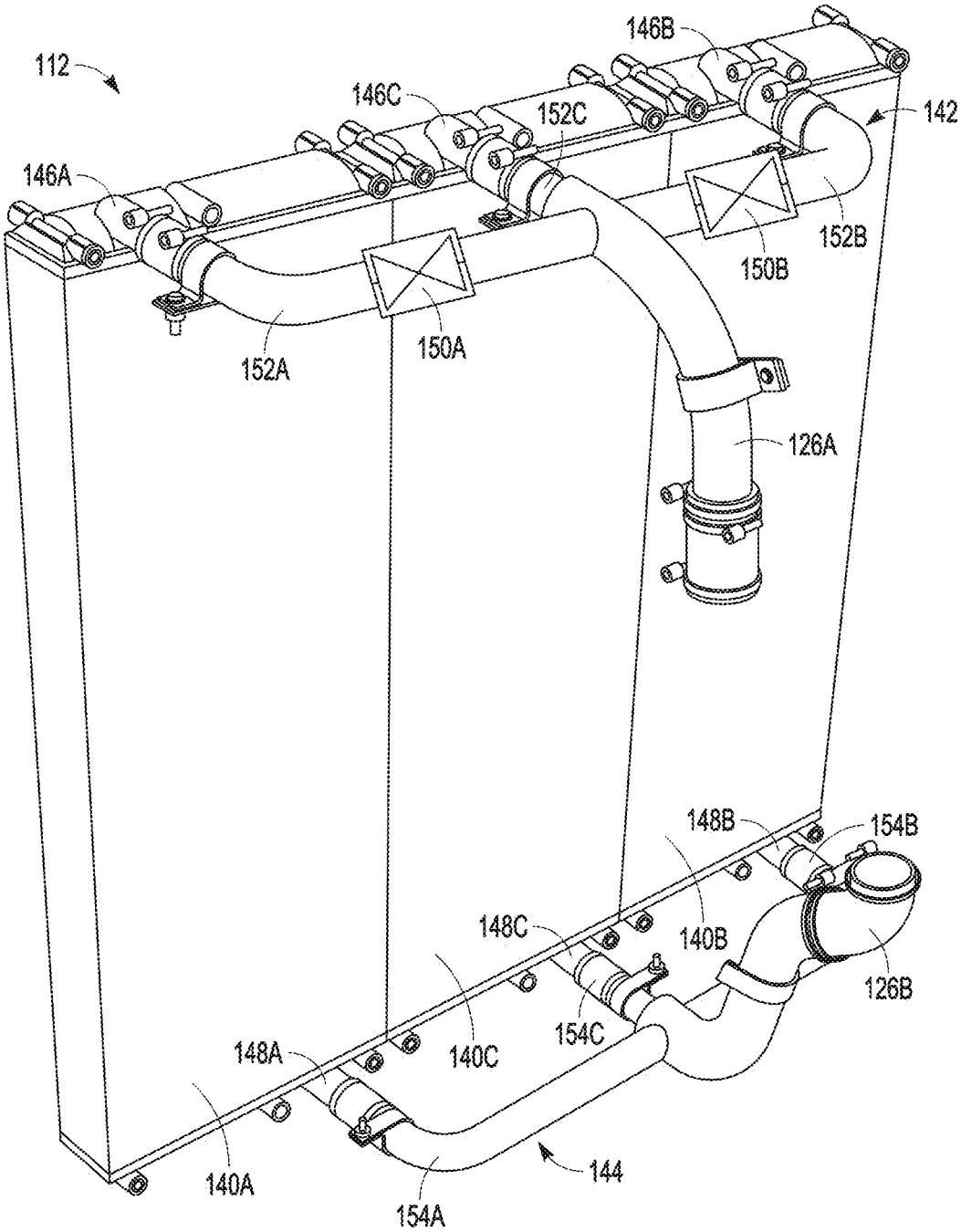
FIG. 3 is a perspective view of a radiator system of the present disclosure suitable for use with the systems of FIGS. 2 and 3 comprising three radiator cores and two flow control valves.
Figure 4:
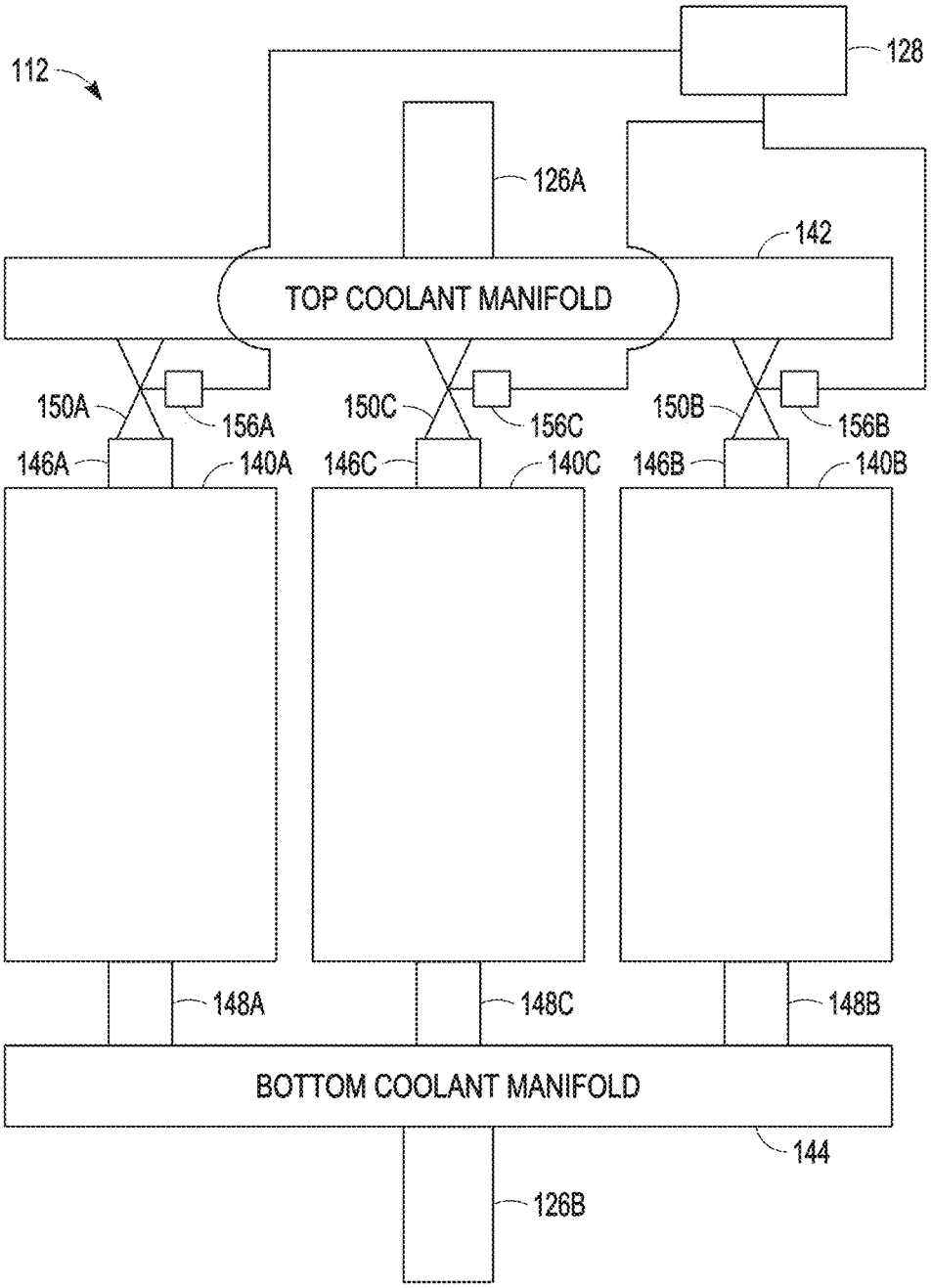
FIG. 4 is a schematic illustration of a radiator system of the present disclosure suitable for use with the systems of FIGS. 2 and 3 comprising three radiator cores and three motorized flow control valves.

As is known, the engine or power plant within engine compartment 110 can generate heat during operation. Engines utilized in haul trucks typically generate a large amount of power in order to move haul truck 100 with a full load. In some cases, a loaded haul truck can weight up to 290,000 pounds or 145 tons (~130,000 kilograms), thereby benefiting from engines having proportionately large displacements. As such, radiator system 112 typically has a proportionally sized capacity to remove the heat generated by the engine. In examples, radiator system 112 can comprise one or more radiator cores sized to cool the engine or power plant with which it is combined. In some examples, the size of the engine for haul truck 100 can be larger than the capacity of the largest radiator cores that can be readily manufactured using conventional mass production techniques. As such, radiator system 112 can include multiple radiator cores fluidly coupled to provide suitable heat exchange capabilities for large displacement engines. The combined radiator cores can be combined in various ways. For example, the radiator cores can be connected in parallel flow arrangements, as shown in FIGS. 3 and 4. However, other flow arrangements such as series flow and hybrid series and parallel flows can be implemented. As discussed herein, flow of cooling fluid through individual radiator cores of the combined radiator cores can be controlled to reduce overall thermal fatigue for radiator system 112 and consolidate or distribute the thermal fatigue to various individual radiator cores.

Figure 2:
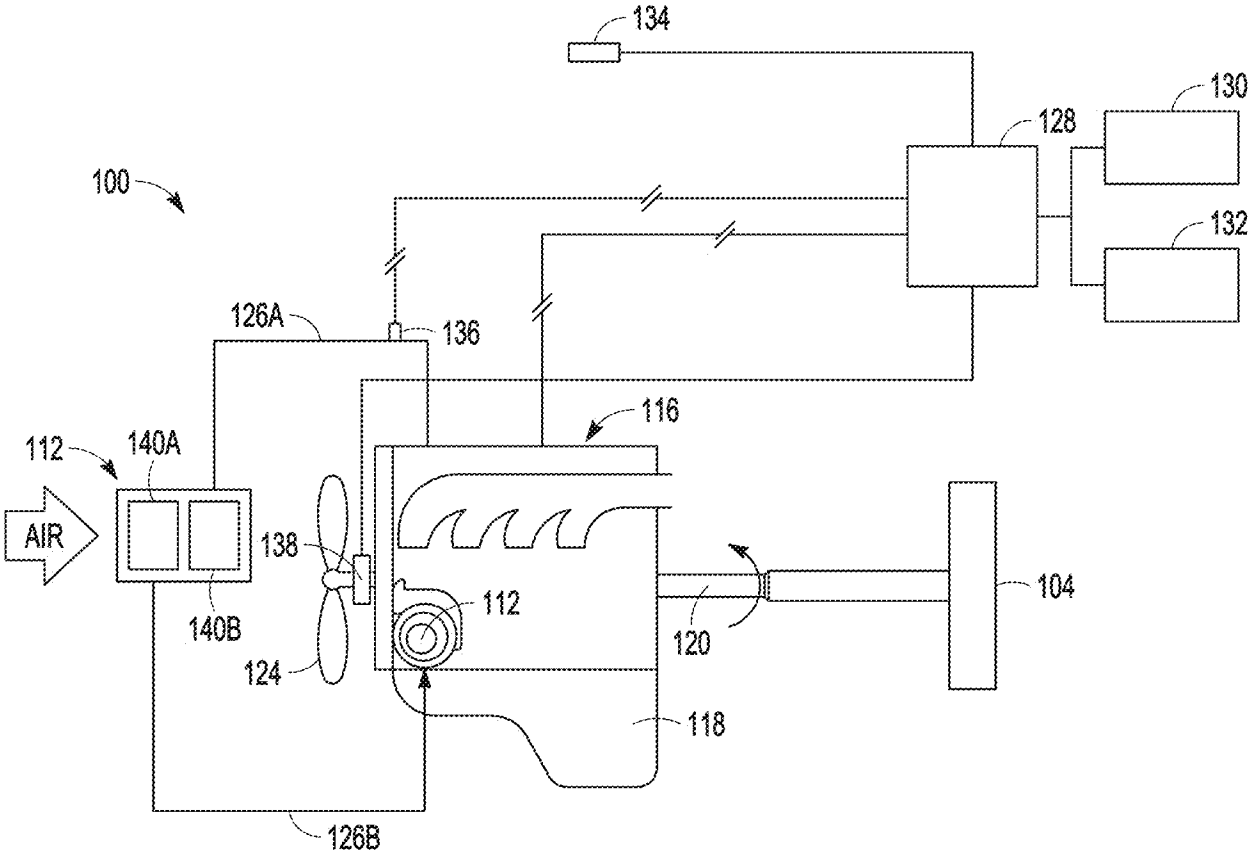
FIG. 2 is a schematic diagram of a control system for a radiator system suitable for use with the haul truck of FIG. 1, the control system configured to control operation of the radiator system and an internal combustion engine.

FIG. 2 is a schematic diagram of power plant 116 suitable for use with haul truck 100 of FIG. 1. Power plant 116 can comprise engine 118, output shaft 120, pump 122 and fan 124. Radiator system 112 can be fluidly connected to power plant 116 via inlet line 126A and outlet line 126B. Radiator system 112 and power plant 116 can be connected to controller 128. Controller 128 can comprise memory device 130 and user interface device 132. Controller 128 can be in communication with ambient temperature sensor 134, coolant temperature sensor 136 and fan speed sensor 138. Radiator system 112 can comprise first radiator core 140A and second radiator core 140B. However, additional radiator cores can be used as shown in FIGS. 3 and 4.

As discussed with reference to FIG. 1, engine 118 can be located within engine compartment 110 of haul truck 100 or another vehicle. However, in other examples, engine 118 and radiator system 112 can be used in other applications and systems, such as other vehicles or power plants used in conjunction with electrical power generation systems. In examples, engine 118 can comprise a diesel engine or a gasoline engine.

Engine 118 can be operated by combusting fuel to produce rotation of output shaft 120. Output shaft 120 can be operatively connected to wheels 104, such as via a drive train including a transmission, gear systems and axels. During operation of engine 118 heat can be generated by the combustion of the fuel. Radiator system 112 can be used to remove heat from engine 118 to prevent components of engine 118 from overheating. In examples, controller 128 can monitor the temperature of engine 118 using coolant temperature sensor 136 and can adjust operations of haul truck 100 to control the temperature of engine 118, such as by adjusting the speeds of pump 122 and fan 124 and operating valves of radiator system 112 as discussed herein. The material, e.g., metals, of engine 118 can be cooled by circulation of a cooling fluid through various portions and passages within an engine block of engine 118. The cooling fluid can absorb heat from the metal of engine 118 and transfer the heat to first radiator core 140A and second radiator core 140B. In examples, inlet line 126A can transfer heated cooling fluid from engine 118 to radiator system 112 and outlet line 126B can transfer cooled cooling fluid from radiator system 112 to engine 118. Pump 122 can be operated to circulate cooling fluid through inlet line 126A, radiator system 112, outlet line 126B and engine 118. In examples, pump 122 can be mechanically operated by coupling to engine 118 to receive rotational input power or can be electrically operated by a motor operated by controller 128. Fan 124 can be operated to drive or force an airflow across first radiator core 140A and second radiator core 140B. The speed of fan 124 can be directly proportional to the speed of engine 118 or can be actively controlled by controller 128 using, for example, input from fan speed sensor 138 and coolant temperature sensor 136.

Controller 128 can be connected to ambient temperature sensor 134 to sense the temperature of ambient air that is surrounding engine 118. In examples, ambient temperature sensor 134 can be mounted to a location of haul truck 100 away from various heat sources such as engine 118 and radiator system 112. Thus, ambient temperature sensor 134 can be mounted to frame 102 (FIG. 1) or the exterior of operator station 106 or other locations. In examples, ambient temperature sensor 134 can comprise a thermocouple, a resistance temperature detector (RTD), a thermistor or a semiconductor based integrated circuit.

Controller 128 can be connected to coolant temperature sensor 136 to sense the temperature of cooling fluid within radiator system 112. In examples, coolant temperature sensor 136 can be located on inlet line 126A to sense the temperature of cooling fluid heated by engine 118. However, coolant temperature sensor 136 can be located in other positions, such as on outlet line 126B. In examples, coolant temperature sensor 136 can comprise a thermocouple, a resistance temperature detector (RTD), a thermistor or a semiconductor based integrated circuit.

Controller 128 can be connected to fan speed sensor 138 to sense the rotational speed of fan 124. In examples, fan speed sensor 138 can be located on the shaft of fan 124 to which fan blades are mounted. However, fan speed sensor 138 can also be configured to sense the rotational speed of a motor that drives fan 124 or the speed of engine 118 in examples where engine 118 is configured to drive fan 124. In examples, fan speed sensor 138 can comprise an eddy-current proximity sensor, a magnetic sensor, or a Hall-effect sensor.

Controller 128 can comprise a circuit board, processor, memory device 130 and user interface device 132, as well as other components such as I/O devices, communication devices and the like. In examples, controller 128 can communicate using wireless communications signals, such as Bluetooth, WiFi, Zigbee, infrared (IR), near field communication (NFC), 3GPP or other technologies. In examples, controller 128 can comprise wired connections to other components, such as ambient temperature sensor 134, coolant temperature sensor 136 and fan speed sensor 138. The circuit board can comprise a structural component for electrically and structurally coupling electrical components of controller 128. The processor can comprise an integrated circuit that can control operation of components of controller 128, such as the I/O devices, sensors, memory devices and user interface devices.

Memory device 130 can comprise any suitable storage device, such as non-volatile, non-transitory, computer-readable memory, magnetic memory, flash memory, volatile memory, programmable read-only memory and the like. Memory device 130 can include instructions stored therein for the processor to control operation of radiator system 112. For example, memory device 130 can include instructions for operating first valve 150A, second valve 150B and third valve 150C (FIGS. 3 and 4), ambient temperature sensor 134, coolant temperature sensor 136 and fan speed sensor 138.

Memory device 130 can additionally include reference data for comparing to data from ambient temperature sensor 134, coolant temperature sensor 136 and fan speed sensor 138, such as lookup tables including the first threshold temperature, second threshold temperature and threshold fan speed (FIG. 5) for determining when first valve 150A, second valve 150B and third valve 150C (FIGS. 3 and 4) can or should be opened or closed.

User interface device 132 can comprise various components for interacting with controller 128, such as input devices and output devices. User interface device 132 can include input devices such as a keyboard, a mouse, a touch screen display, as well as others. User interface device 132 can include output devices such as a touch screen display, a computer monitor, an audio speaker an LCD or LED screen, as well as others. The output device can be used to display to an operator of haul truck 100 (FIG. 1), such as output from ambient temperature sensor 134, coolant temperature sensor 136 and fan speed sensor 138, such as information from the lookup tables including the first threshold temperature, second threshold temperature and threshold fan speed (FIG. 5), and the open or closed status of first valve 150A, second valve 150B and third valve 150C (FIGS. 3 and 4).

Output of ambient temperature sensor 134, coolant temperature sensor 136 and fan speed sensor 138 can be used to operate radiator system 112 according to the present disclosure. For example, controller 128 can obtain output of ambient temperature sensor 134 to determine the temperature of ambient air that is surrounding engine 118 and radiator system 112. Controller 128 can determine how much of the total cooling capacity of radiator system 112 will likely to be used or needed to provide cooling to engine 118 based on how much heat the ambient air can remove from first radiator core 140A and second radiator core 140B. Thus, if the temperature of the ambient air is sufficiently cold where only one of first radiator core 140A and second radiator core 140B can provide adequate cooling to the cooling fluid, appropriate valving of radiator system 112 can be operated to reduce or eliminate flow of cooling fluid through one of the cores, thereby reducing thermal stress imparted to that radiator core.

FIG. 3 is a perspective view of radiator system 112 suitable for use with the systems of FIGS. 1 and 2. Radiator system 112 can comprise first radiator core 140A, second radiator core 140B, third radiator core 140C, inlet manifold 142 and outlet manifold 144. First radiator core 140A can comprise first inlet 146A and first outlet 148A. Second radiator core 140B can comprise second inlet 146B and second outlet 148B. Third radiator core 140C can comprise third inlet 146C and third outlet 148C. Radiator system 112 can also comprise first valve 150A and second valve 150B. Inlet manifold 142 can connect to inlet line 126A and outlet manifold 144 can connect to outlet line 126B.

In the illustrated example, radiator system 112 can comprise three separate radiator cores configured to receive heated cooling fluid and dissipate heat from the heated cooling fluid to surrounding air. Specifically, radiator system 112 can comprise first radiator core 140A, second radiator core 140B and third radiator core 140C. First radiator core 140A, second radiator core 140B and third radiator core 140C can be positioned between inlet manifold 142 and outlet manifold 144 to receive flows of cooling fluid in parallel. As such, cooling fluid can flow between inlet manifold 142 and outlet manifold 144 through each of first radiator core 140A, second radiator core 140B and third radiator core 140C individually at the same time. As mentioned, in other examples, cooling fluid flow through first radiator core 140A, second radiator core 140B and third radiator core 140C can have other arrangements, such as series flow or hybrid flow, such as where, for example, first radiator core 140A and second radiator core 140B can be arranged in series flow while being in parallel flow with third radiator core 140C. As discussed herein, first valve 150A, second valve 150B and third valve 150C can be operated to control flow through one or more of first radiator core 140A, second radiator core 140B and third radiator core 140C.

Inlet line 126A can be connected to an engine block to receive cooling fluid that has flowed through cooling passages of engine 118 (FIG. 2). Flow of cooling fluid from inlet line 126A can enter inlet manifold 142. Inlet manifold 142 can be configured to divide the flow of cooling fluid from inlet line 126A into different streams for the number of radiator cores comprising radiator system 112. In the illustrated example, inlet manifold 142 can be configured to generate three output flows at first outlet 152A, second outlet 152B and third outlet 152C. However, inlet manifold 142 can be configured to generate other amounts of output flows, such as two, four, five or more, to match to number of radiator cores in or flow paths through radiator system 112. First outlet 152A can connect to first inlet 146A of first radiator core 140A, second outlet 152B can connect to second inlet 146B of second radiator core 140B, and third outlet 152C can connect to third inlet 146C of third radiator core 140C. Inlet manifold 142 can be fabricated from appropriate tubes, pipes, connectors and housings as determined to be suitable for conveying cooling fluid from inlet line 126A to first inlet 146A, second inlet 146B and third inlet 146C.

In examples, first radiator core 140A, second radiator core 140B and third radiator core 140C can comprise tube-and-fin heat exchangers, tubular-lamellar heat exchangers, tubular and tape heat exchangers, serpentine fin core heat exchangers, plate fin core heat exchangers and others. In examples, first radiator core 140A, second radiator core 140B and third radiator core 140C can be sized to have equal cooling fluid volume or cooling capacity. Accordingly, in some examples, flow from inlet manifold 142 can be divided equally to first inlet 146A, second inlet 146B and third inlet 146C. However, first radiator core 140A, second radiator core 140B and third radiator core 140C can have cooling fluid volume or cooling capacities that are different from each other, with amounts of cooling fluid flowing therethrough according to size or capacity. In examples, each of first radiator core 140A, second radiator core 140B and third radiator core 140C are shaped as elongate rectangles oriented to have cooling fluid flow along the major axis of the rectangle. As such, gravity can assist in moving cooling fluid from inlet manifold 142, through first radiator core 140A, second radiator core 140B and third radiator core 140C, and into outlet manifold 144. However, first radiator core 140A, second radiator core 140B and third radiator core 140C can be arranged in different orientations. FIG. 3 illustrates radiator system 112 having first radiator core 140A, second radiator core 140B and third radiator core 140C integrated into a single housing, such as housing 114 (FIG. 1). However, first radiator core 140A, second radiator core 140B and third radiator core 140C can be split apart into different housings or packages located at different positions on haul truck 100, for example, and still remain connected by appropriate manifolds and piping to allow for cooling fluid to flow through each core in parallel.

Flow of cooling fluid from first radiator core 140A, second radiator core 140B and third radiator core 140C can enter outlet manifold 144 from first outlet 148A, second outlet 148B and third outlet 148C, respectively. Outlet manifold 144 can be configured to consolidate the flow of cooling fluid from first radiator core 140A, second radiator core 140B and third radiator core 140C and provide the consolidated flow to outlet line 126B. In the illustrated example, outlet manifold 144 can be configured to consolidate three output flows at first inlet 154A, second inlet 154B and third inlet 154C. However, outlet manifold 144 can be configured to receive other amounts of input flows, such as two, four, five or more, to match to number of radiator cores in or flow paths through radiator system 112. First inlet 154A can connect to first outlet 148A of first radiator core 140A, second inlet 154B can connect to second outlet 148B of second radiator core 140B, and third inlet 154C can connect to third outlet 148C of third radiator core 140C. Outlet line 126B can be connected to an engine block to provide cooling fluid that has flowed through radiator system 112 to engine 118 (FIG. 2). Outlet manifold 144 can be fabricated from appropriate tubes, pipes, connectors and housings as determined to be suitable for conveying cooling fluid from first outlet 148A, second outlet 148B and third outlet 148C to outlet line 126B.

First valve 150A and second valve 150B can be positioned within radiator system 112 to control flow of cooling fluid through first radiator core 140A, second radiator core 140B and third radiator core 140C. First valve 150A and second valve 150B are shown positioned at inlet manifold 142, but can be positioned at outlet manifold 144. First valve 150A and second valve 150B are configured for controlling flow through first radiator core 140A and second radiator core 140B, respectively. However, valves can be positioned on any or all of first radiator core 140A, second radiator core 140B and third radiator core 140C. In the specific example shown, first valve 150A is positioned on first outlet 152A of inlet manifold 142 for controlling flow through first radiator core 140A and second valve 150B is positioned on second outlet 152B of inlet manifold 142 for controlling flow through second radiator core 140B. As such, flow through third radiator core 140C can be uncontrolled by a valve and can be continuous for any operating state of first valve 150A and second valve 150B when cooling fluid is running through radiator system 112. First valve 150A and second valve 150B can comprise any suitable valve for controlling flow of cooling fluid, such as ball valves, butterfly valves, gate valves, diaphragm valves, piston valves, plug valves, pinch valves and the like.

As discussed herein, first valve 150A and second valve 150B can be opened when radiator system 112 is operating above a first threshold temperature for ambient air. The first threshold temperature can be a minimum temperature where cooling capacity provided by each of first radiator core 140A, second radiator core 140B and third radiator core 140C is desirable for cooling the cooling fluid to provide desired cooling for engine 118 (FIG. 2). In examples, the first threshold temperature can be the lowest temperature where the cooling capacity of third radiator core 140C and both of first radiator core 140A and second radiator core 140B is suitable to provide cooling to the cooling fluid such that cooling from both of first radiator core 140A and second radiator core 140B, in addition to third radiator core 140C, is desired to provide the desired level of cooling to the cooling fluid. In other words, at or above the first threshold temperature, the ambient temperature is hot enough where all three of first radiator core 140A, second radiator core 140B and third radiator core 140C are desired to provide cooling to the cooling fluid. In examples, the first temperature threshold can be approximately 0° C. Thus, if the ambient temperature is at or above 0° C., first valve 150A and second valve 150B can be opened to utilize cooling capacity from first radiator core 140A, second radiator core 140B and third radiator core 140C. However, if the ambient temperature is below 0° C. one of first valve 150A and second valve 150B can be closed because the cooler ambient temperatures result in only two of first radiator core 140A, second radiator core 140B and third radiator core 140C being able to provide the desired level of cooling to maintain engine 118 (FIG. 2) at or below the desired operating temperature, which can be sensed by coolant temperature sensor 136 (FIG. 2).

In additional examples, radiator system 112 can be operated with reference to a second temperature threshold. The second threshold temperature can be a minimum temperature where cooling capacity provided by two of first radiator core 140A, second radiator core 140B and third radiator core 140C is desirable for cooling the cooling fluid to provide desired cooling for engine 118 (FIG. 2). In examples, the second threshold temperature can be the lowest temperature where the cooling capacity of third radiator core 140C and one of first radiator core 140A and second radiator core 140B are suitable to provide cooling to the cooling fluid such that cooling from one of first radiator core 140A and second radiator core 140B, in addition to third radiator core 140C, is desired to provide the desired level of cooling to the cooling fluid. In other words, at or above the second threshold temperature, the ambient temperature is warm enough where only two of first radiator core 140A, second radiator core 140B and third radiator core 140C are desired to provide cooling to the cooling fluid. In examples, the second temperature threshold can be approximately −20° C. Thus, if the ambient temperature is at or above −20° C., one of first valve 150A and second valve 150B can be opened to utilize cooling capacity from one of first radiator core 140A and second radiator core 140B, as well as third radiator core 140C. However, if the ambient temperature is below −20° C., both of first valve 150A and second valve 150B can be closed because the cold ambient temperatures result in only one of first radiator core 140A, second radiator core 140B and third radiator core 140C being able to provide the desired level of cooling to maintain engine 118 (FIG. 2) at or below the desired operating temperature, which can be sensed by coolant temperature sensor 136 (FIG. 2).

Operating States of Cooling Fluid Valves

TABLE 1

| Ambient Temperature | First Valve 150A State | Second Valve 150B State |
|---|---|---|
| ≥0° C. | Opened | Opened |
| 0° C. ≤ −20° C. | Closed | Opened |
| −20° C. ≤ −40° C. | Closed | Closed |

TABLE 1 can be summarized as follows: ambient temperatures at or above the first temperature threshold can result in cooling fluid flow through first radiator core 140A, second radiator core 140B and third radiator core 140C; ambient temperatures at or above the second temperature threshold, but below the first temperature threshold, can result in cooling fluid flow through second radiator core 140B and third radiator core 140C; ambient temperatures below the second temperature threshold can result in cooling fluid flow through third radiator core 140C. TABLE 1 provides an example of operating states and operating temperatures. In other examples, different valves can be actuated in different orders and different temperatures can be used. For example, second valve 150B can be configured to close before first valve 150A. In examples, the first temperature threshold could be another temperature, such as 20° C., 10° C., 5° C., −5° C. or others, and the second temperature threshold could be another temperature, such as −10° C.-15° C., −25° C. or others. In examples, the temperature thresholds can be within a range of the selected temperatures, such as plus or minus five percent.

In examples, operation of first valve 150A and second valve 150B can be conducted manually by an operator of radiator system 112 or haul truck 100 (FIG. 1). A temperature reading for the ambient temperature of haul truck 100 can be displayed within operator station 106, such as on a display screen of user interface device 132. The ambient temperature can be sensed with ambient temperature sensor 134 (FIG. 2). The operator can compare the output of ambient temperature sensor 134, or another temperature sensors or a thermometer, to the information in TABLE 1. TABLE 1 can be located in an operator's manual, on a sticker or sign within operator station 106, or on information displayed on a digital screen within operator station 106 or a handheld device. First valve 150A and second valve 150B can be manually operated based on information obtained from TABLE 1. In examples, the operator can operate first valve 150A and second valve 150B from outside of operator station 106, such as by standing proximate to housing 114. In other examples, first valve 150A and second valve 150B can be located within operator station 106 using appropriate cooling fluid plumbing so that the operator need not leave operator station 106 to control the operating states of radiator system 112. In other examples, first valve 150A and second valve 150B can be controlled by controller 128 (FIG. 2) using motorized valves, as discussed with reference to FIG. 4.

In the example of FIG. 3, flow of cooling fluid is configured to always flow through third radiator core 140C, flow of cooling fluid is least likely to be flowing through first radiator core 140A because first valve 150A closes based on the first and second temperature thresholds, and volumetric flow through second radiator core 140B is between that of third radiator core 140C and first radiator core 140A. As such, third radiator core 140C will likely receive the most amount of thermal stress, second radiator core 140B will likely receive the second most amount of thermal stress, and first radiator core 140A will likely receive the least amount of thermal stress. In examples, the thermal stress induced in third radiator core 140C may be such that first radiator core 140A will not need replacing over the life of haul truck 100, while third radiator core 140C will need to be replaced multiple times. However, without the systems and devices of the present disclosure all three of first radiator core 140A, second radiator core 140B and third radiator core 140C would see the same amount of thermal stress that only third radiator core 140C receives using the multi-core radiators and control methods of the present disclosure. As such, maintenance efforts and costs can be focused on repair or replacement of only a single radiator core, thereby reducing costs over the lifetime of radiator system 112 and haul truck 100 (FIG. 1). However, a third valve can be added to third radiator core 140C to allow for selection of which radiator core receives flow under any ambient operating conditions, as discussed with reference to FIG. 4.

FIG. 4 is a schematic illustration of radiator system 112 of the present disclosure suitable for use with systems of FIGS. 2 and 3 comprising first radiator core 140A, second radiator core 140B and third radiator core 140C, along with first valve 150A, second valve 150B and third valve 150C. First valve 150A, second valve 150B and third valve 150C can be connected to first motor 156A, second motor 156B and third motor 156C, respectively. Radiator system 112 of FIG. 4 can be configured similarly as radiator system 112 of FIG. 3 with the addition of third valve 150C, first motor 156A, second motor 156B and third motor 156C.

First valve 150A, second valve 150B and third valve 150C can be operated by controller 128 using various electronic command signals, such as those that can be issued after executing control logic discussed with reference to FIG. 5. First valve 150A, second valve 150B and third valve 150C can comprise any suitable valve for controlling flow of cooling fluid that can be controlled by first motor 156A, second motor 156B and third motor 156C, such as ball valves, butterfly valves, gate valves, plug valves and the like.

Radiator system 112 of FIG. 4 can operate similarly as that of FIG. 3 to reduce flow from three radiator cores to two radiator cores to one radiator core as ambient temperatures drop past first and second temperature thresholds. However, the inclusion of a control valve on all three radiator cores allows for flow of cooling fluid through any of the radiator cores under any operating conditions. As such, an operator or controller 128 can distribute thermal stresses to different radiator cores rather than concentrating thermal stresses in a single radiator core.

In the example of FIG. 4, flow of cooling fluid can be configured to flow through any one of third radiator core 140C, second radiator core 140B and first radiator core 140A because any one of first valve 150A, second valve 150B and third valve 150C can be closed at the first temperature threshold and either of the remaining two valves can be closed at the second temperature threshold. As such, an operator or controller 128 can change the sequence in which first valve 150A, second valve 150B and third valve 150C are closed, such as on different days, seasons or years that haul truck 100 is operated or each time haul truck 100 is started, to spread thermal stresses across first radiator core 140A, second radiator core 140B and third radiator core 140C. Thus, because thermal stress is not being generated in all of first radiator core 140A, second radiator core 140B and third radiator core 140C every time radiator system 112 incurs thermal stress, the overall life of each of first radiator core 140A, second radiator core 140B and third radiator core 140C can be increased. In examples, the thermal stress induced in first radiator core 140A, second radiator core 140B and third radiator core 140C may be such that first radiator core 140A, second radiator core 140B and third radiator core 140C will not need replacing over the life of haul truck 100. However, the thermal stress induced in each of first radiator core 140A, second radiator core 140B and third radiator core 140C will in any event be less than if the systems and devices of the present disclosure were not utilized, thereby reducing maintenance efforts and costs over the lifetime of radiator system 112 and haul truck 100 (FIG. 1).

Figure 5:
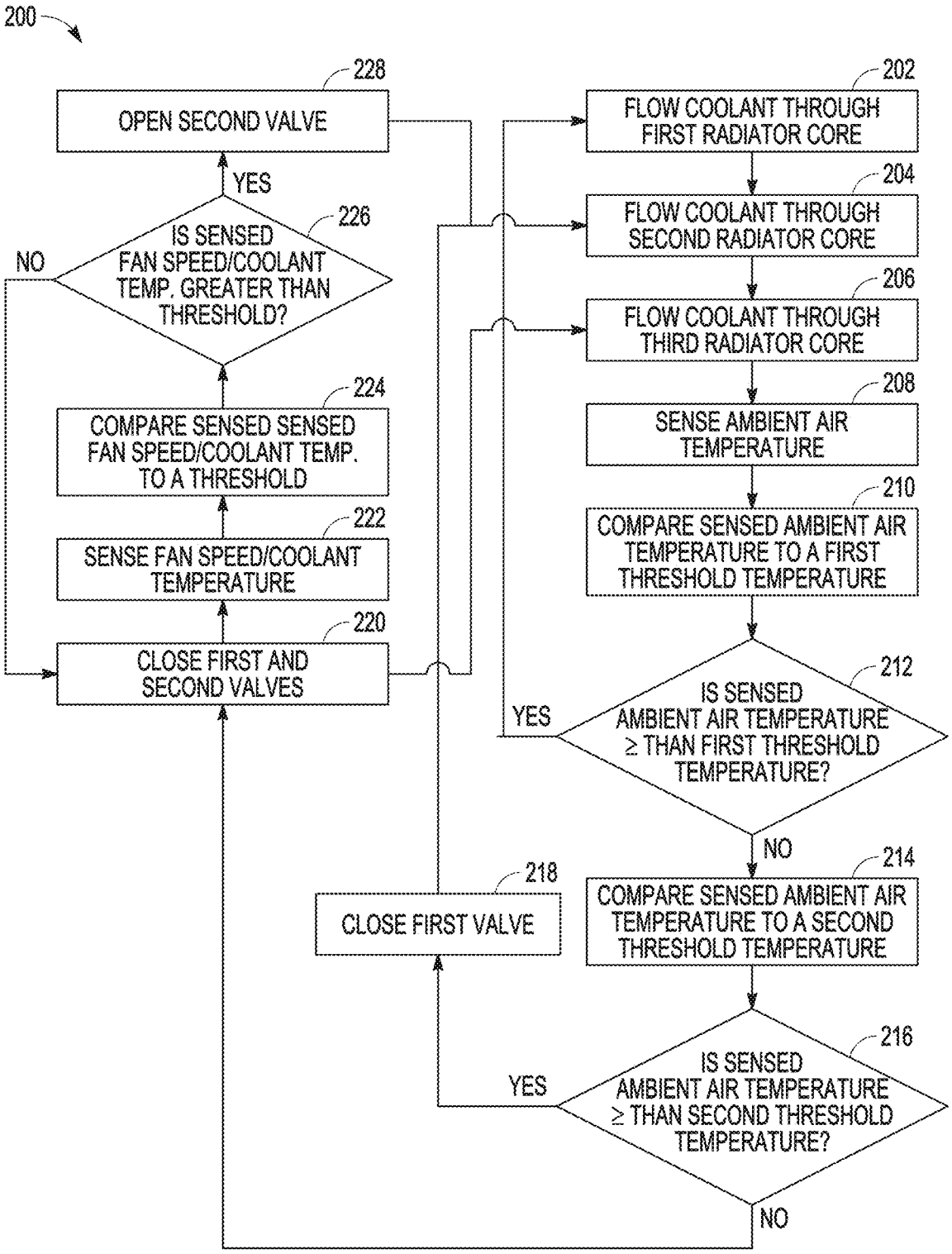
FIG. 5 is a line diagram illustrating various operations for controlling flow of cooling fluid through multiple radiator cores of a radiator system of the present disclosure.

FIG. 5 is a line diagram illustrating method 200 including various operations for controlling flow of cooling fluid through multiple radiator cores of a radiator system of the present disclosure. Method 200 can be used to reduce flow through different cores of a multi-core radiator system as ambient temperatures drop past various temperature thresholds.

At operation 202, coolant can be flowed through a first radiator core, such as by operation of pump 122 of engine 118 (FIG. 2). In examples, the first radiator core can comprise first radiator core 140A (FIG. 4). Flow through the first radiator core can be achieved by having a first valve, such as first valve 150A (FIG. 4), in an open state.

At operation 204, coolant can be flowed through a second radiator core, such as by operation of pump 122 of engine 118 (FIG. 2). In examples, the second radiator core can comprise second radiator core 140B (FIG. 4). Flow through the second radiator core can be achieved by having a second valve, such as second valve 150B (FIG. 4), in an open state.

At operation 206, coolant can be flowed through a third radiator core, such as by operation of pump 122 of engine 118 (FIG. 2). In examples, the third radiator core can comprise third radiator core 140C (FIG. 4). Flow through the third radiator core can be achieved by having a third valve, such as third valve 150C (FIG. 4), in an open state.

Operations 202—operations 206 can be achieved when radiator system 112 is operating while engine 118 (FIG. 2) of haul truck 100 (FIG. 1) operating. For example, pump 122 (FIG. 2) can be operating to circulate cooling fluid through inlet line 126A and outlet line 126B (FIG. 2). As such, engine 118 can be generating heat, and the cooling fluid can take on such heat for dispersion in first radiator core 140A, second radiator core 140B and third radiator core 140C.

At operation 208, ambient temperature can be sensed. In examples, measurements from ambient temperature sensor 134 (FIG. 2) can be obtained by controller 128 to determine the ambient temperature. In examples, an operator can consult a thermometer or temperature reading output on user interface device 132 to visually obtain an ambient temperature indication.

At operation 210, the sensed ambient temperature can be compared to a first threshold temperature. Controller 128 can consult a lookup table stored in memory device 130 having TABLE 1 stored therein to compare the sensed ambient temperature to the first threshold temperature. Additionally, an operator can compare a thermometer reading or a temperature readout to printed information including TABLE 1 in a user manual or a label in operator station 106 (FIG. 1) or digital information displayed on a computing device.

At operation 212, it can be determined if the sensed ambient temperature is equal to or greater than the first threshold temperature. If the ambient temperature is at or above the first threshold temperature, method 200 can return to operation 202 and no changes in the operating states of first valve 150A, second valve 150B and third valve 150C will occur. If the ambient temperature is not at or above the first threshold temperature, i.e., is below the first threshold temperature, method 200 can move to operation 214.

At operation 214, the sensed ambient temperature can be compared to a second threshold temperature. Controller 128 can consult a lookup table stored in memory device 130 having TABLE 1 stored therein to compare the sensed ambient temperature to the second threshold temperature. Additionally, an operator can compare a thermometer reading or a temperature readout to printed information including TABLE 1 in a user manual or a label in operator station 106 (FIG. 1) or digital information displayed on a computing device.

At operation 216, it can be determined if the sensed ambient temperature is equal to or greater than the second threshold temperature. If the ambient temperature is at or above the second threshold temperature, method 200 can move to operation 218. If the ambient temperature is not at or above the second threshold temperature. i.e., is below the second threshold temperature, method 200 can move to operation 220.

At operation 218, first valve 150A can be closed. As discussed herein, first valve 150A can be manually closed by an operator or can be automatically closed by controller 128 using first motor 156A. Thereafter, method 200 can return to operation 204 to continue to flow cooling fluid through second radiator core 140B at operation 204 and third radiator core 140C at operation 206.

At operation 220, first valve 150A and second valve 150B can be closed. As discussed herein, first valve 150A and second valve 150B can be manually closed by an operator or can be automatically closed by controller 128 using first motor 156A and second motor 156B. Thereafter, method 200 can return to operation 206 to continue to flow cooling fluid through third radiator core 140C at operation 206.

However, method 200 can include one or more safety check operations to verify if cooling being provided by only third radiator core 140C is sufficient to maintain engine 118 within desired operating temperature rages. The speed of fan 124 (FIG. 2) can be used as a proxy to determine if the temperature of engine 118 (FIG. 2) is too high. Additionally, as discussed below, instead of or in addition to checking fan speed, coolant temperature can be directly checked using coolant temperature sensor 136 (FIG. 2) so that controller 128 or an operator can determine if engine 118 is operating at too high of temperatures.

At operation 222, the speed of fan 124 can be sensed. In examples, measurements from fan speed sensor 138 (FIG. 2) can be obtained by controller 128 to determine the speed of fan 124. In additional examples, an operator of haul truck 100 (FIG. 1) can consult a fan speed gauge displayed in operator station 106 to check the speed of fan 124 to obtain the speed of fan 124.

At operation 224, the sensed fan speed can be compared to a threshold fan speed. Controller 128 can consult a lookup table stored in memory device 130 to compare the sensed fan speed to the threshold fan speed. Additionally, an operator can compare a fan speed gauge reading to printed information in a user manual or a label in operator station 106 (FIG. 1) or digital information displayed on a computing device. In examples, fan 124 operate upwards of approximately 2,400 revolutions per minute (RPM) in extreme operating conditions. If fan 124 is operating at speeds over 2,400 RPM, this can be an indication that the cooling fluid is not providing adequate cooling to engine 118 and additional cooling is needed, such as by additional cooling from fan 124. As such, controller 128 can act to open another radiator core to cool the cooling fluid if fan 124 operates at higher speeds than in typical operating conditions.

At operation 226, it can be determined if the sensed fan speed is equal to or greater than the threshold fan speed. If the sensed fan speed is at or above the threshold fan speed, method 200 can move to operation 228. If the sensed fan speed is not at or above the threshold fan speed, i.e., is below the threshold fan speed, method 200 can move to operation 228.

At operation 228, second valve 150B can be opened. The actual fan speed being above the threshold fan speed can indicate that the cooling fluid is not being cooled to desired levels to provide the desired cooling to engine 118 (FIG. 2).

This can indicate that third radiator core 140C cannot provide the desired heat dissipation to the cooling fluid alone. Thereafter, method 200 can move to operation 204 to allow cooling fluid to flow through second radiator core 140B and third radiator core 140C to provide additional heat dissipation capacity to the cooling fluid.

In additional examples, the temperature of the cooling fluid in radiator system 112 can be directly sensed using coolant temperature sensor 136 rather than using the speed of fan 124 as a proxy for the temperature of the cooling fluid. Thus, controller 128 can utilize coolant temperature sensor 136 to sense a temperature of the cooling fluid flowing through radiator system 112, such as at inlet line 126A. Controller 128 can compare the sensed temperature of the cooling fluid to a threshold cooling fluid temperature that can be stored in memory device 130. Controller 128 can open opening first valve 150A or second valve 150B if the sensed cooling fluid temperature is above the threshold cooling fluid temperature. Method 200 can include operations similar to operation 222—operation 228 that can be executed to by controller 128 to use coolant temperature as an indication of the performance of radiator system 112.

INDUSTRIAL APPLICABILITY

In examples, first radiator core 140A, second radiator core 140B and third radiator core 140C can comprise tube-and-fin heat exchangers, tubular-lamellar heat exchangers, tubular and tape heat exchangers, serpentine fin core heat exchangers, plate fin core heat exchangers and others. Such radiator cores are typically fabricated from metal components such as copper, aluminum brass and steel.

During typical operating conditions of haul truck 100 at ambient temperatures of 25° C., the temperature of cooling fluid, or coolant, within radiator system 112 can reach temperatures in the range of approximately 80° C. to 85° C. However, haul truck 100 can operate in various environmental conditions, including in arctic conditions where temperatures can reach −40° C. The introduction of heated coolant into a cold radiator core can induce thermal stress in the metal comprising the radiator core components. Repeated exposure to thermal stress can result in fatigue cracking of the radiator core components, which can require repair or replacement of the radiator system.

In some cases, low ambient temperatures can result in overcooling of the coolant. In such scenarios, it can be advantageous to cover all or a portion of the radiator to reduce the effectiveness of the heat transfer. In other examples where the radiator fan is uncoupled from the speed of the engine, the speed of the fan can be reduced to slow the heat transfer process by controlling a fan motor. However, such procedures do not reduce or eliminate thermal stress and related fatigue cracking issues.

With the present disclosure, individual radiator cores within a radiator system can be closed off, e.g., interrupted, from receiving flow of coolant in various could weather conditions to take advantage of the reduced cooling demand placed on the radiator system in cold weather. Closing off of individual radiator cores can prevent such cores from experiencing thermal stress, thereby reducing the occurrence of thermal fatigue and related cracking issues. In examples, radiator cores can be manually closed off via operator action when whether conditions area conducive. In examples, various sensor inputs can be used to determine conditions when radiator cores can be closed off and, in various examples, actuate motorized valves. In examples, thermal fatigue can be concentrated in an un-valved radiator core, such as third radiator core 140C of FIG. 3, to concentrate repair efforts and repair costs around a single radiator core. In examples, thermal fatigue can be distributed between all valved radiator cores, such as first radiator core 140A, second radiator core 140B and third radiator core 140C of FIG. 4, to delay repair efforts and costs.

With the systems and methods of the present disclosure, radiator systems can be designed to have a desired cooling fluid capacity at elevated temperatures and can be designed to operate at full capacity using each core in a multi-core radiator system. The radiator system, including fan sizes and pump sizes, can accommodate pressure losses in the flow of cooling fluid when cooling fluid is flowing through each of the cores. Thus, operating the radiator systems at full cooling capacity does not incur additional pressure losses, such as by adding capacity of an auxiliary or secondary radiator core that is not always used, such as those that can be connected in a series flow relationship. Additional pressure losses are not incurred when an individual radiator core is closed-off as disclosed herein. As such, the performances of pump 122 and fan 124 are not affected by the various operating modes or states described herein.

What is claimed is:

1. A radiator system for cooling an internal combustion engine, the radiator system comprising:

a first radiator core having a first inlet and a first outlet;

a second radiator core having a second inlet and a second outlet;

an inlet manifold connected to the first inlet and the second inlet;

an outlet manifold connected to the first outlet and the second outlet;

a cooling fluid circuit configured to circulate a cooling fluid through the inlet manifold, the first radiator core, the second radiator core, the outlet manifold, and the internal combustion engine;

a first valve positioned on the inlet manifold to control a flow of the cooling fluid through the first radiator core;

an ambient air temperature sensor configured to sense a temperature of ambient air;

a cooling fluid temperature sensor configured to sense a temperature of the cooling fluid within the cooling fluid circuit;

a fan configured to drive the ambient air across the first radiator core and the second radiator core;

a fan speed sensor configured to sense a rotational speed of the fan; and a memory device having stored therein instructions for, based on an output of at least one of the ambient air temperature sensor, the cooling fluid temperature sensor, and the fan speed sensor, opening the first valve to allow for parallel flow of the cooling fluid through the first radiator core and the second radiator core between the inlet manifold and the outlet manifold; and closing the first valve to interrupt the flow of the cooling fluid through the first radiator core between the inlet manifold and the outlet manifold.

2. The radiator system of claim 1, wherein the first radiator core has a first coolant volume and the second radiator core has a second coolant volume, wherein the first coolant volume and the second coolant volume are equal.

3. The radiator system of claim 1, further comprising a second valve positioned on the inlet manifold to control the flow of the cooling fluid through the second radiator core, wherein the second valve is opened and closed based on the output of at least the ambient air temperature sensor.

4. The radiator system of claim 3, further comprising:
a third radiator core comprising:
a third inlet connected to the inlet manifold; and
a third outlet connected to the outlet manifold; and
a third valve positioned on the inlet manifold to control a flow of the cooling fluid through the third radiator core.

5. The radiator system of claim 1, wherein the ambient air temperature sensor is mounted to a frame or an exterior of an operator station of a haul truck to provide an indication of the ambient air temperature.

6. The radiator system of claim 5, further comprising:
a first motor configured to operate the first valve; and
a controller in electronic communication with the ambient air temperature sensor and the first motor, the controller configured to operate the first motor based on the output of two or more of the ambient air temperature sensor, the cooling fluid temperature sensor, and the fan speed sensor.

7. The radiator system of claim 6, further comprising:
a second valve positioned on the inlet manifold to control the flow of the cooling fluid through the second radiator core; and
a second motor configured to operate the second valve,
wherein the memory device has stored therein:
one or more temperature thresholds where ambient operating temperatures are sufficient for using only one of the first radiator core and the second radiator core to cool the cooling fluid; and
instructions for closing the first valve or the second valve if the ambient air temperature is below at least one of the one or more temperature thresholds,
wherein ambient air temperature sensor readings from the ambient air temperature sensor to compare to the one or more temperature thresholds are obtained before the internal combustion engine is started.

8. A method of controlling a flow of a cooling fluid through a radiator system having a plurality of radiator cores, the method comprising:
flowing the cooling fluid through the radiator system and an internal combustion engine, the radiator system comprising a first radiator core and a second radiator core;
sensing a first temperature of ambient air with an ambient air temperature sensor;
comparing the first temperature of ambient air to a first threshold ambient air temperature;
sensing a speed of a fan configured to drive the ambient air across the first radiator core and the second radiator core;
comparing the sensed fan speed to a threshold fan speed;
sensing a temperature of the cooling fluid flowing through the radiator system;
comparing the sensed temperature of the cooling fluid to a threshold cooling fluid temperature;
opening a first valve positioned on an inlet manifold of the radiator system to allow for parallel flow of the cooling fluid through the first radiator core and the second radiator core if the first temperature of ambient air is greater than or equal to the first threshold ambient air temperature, the sensed fan speed is greater than or equal to the threshold fan speed, or the sensed temperature of the cooling fluid is greater than or equal to the threshold cooling fluid temperature; and
closing the first valve to reduce the flow of the cooling fluid through the first radiator core if the first temperature of ambient air is below the first threshold ambient air temperature, the sensed fan speed is below the threshold fan speed, or the sensed temperature of the cooling fluid is below the threshold cooling fluid temperature.

9. The method of claim 8, wherein reducing the flow of the cooling fluid through the first radiator core comprises using a controller to automatically operate a first motor to close the first valve.

10. The method of claim 9, wherein using the controller to automatically operate the first motor to close the first valve is based on an output of the ambient air temperature sensor to limit thermal fatigue and associated cracking in the first radiator core, wherein ambient air temperature sensor readings from the ambient air temperature sensor to compare to the first threshold ambient air temperature are obtained before the internal combustion engine system is started.

11. The method of claim 9, wherein flowing the cooling fluid through the radiator system further comprises flowing the cooling fluid through a third radiator core.

12. The method of claim 11, further comprising:
comparing the first temperature of ambient air to a second threshold ambient air temperature; and
closing a second valve positioned on the inlet manifold to reduce the flow of the cooling fluid through the second radiator core if the first temperature of ambient air is below the second threshold ambient air temperature.

13. The method of claim 12, wherein
reducing the flow of the cooling fluid through the second radiator core comprises using the controller to automatically operate a second motor to close the second valve.

14. The method of claim 13, further comprising:
opening the first valve or the second valve if the sensed fan speed is above the threshold fan speed.

15. The method of claim 13, further comprising;
opening the first valve or the second valve if the sensed temperature of the cooling fluid is above the threshold cooling fluid temperature.

16. A radiator system for cooling an internal combustion engine, the radiator system comprising:
a first radiator core having a first inlet and a first outlet;
a second radiator core having a second inlet and a second outlet;
an inlet manifold connected to the first inlet and the second inlet;
an outlet manifold connected to the first outlet and the second outlet;
a cooling fluid circuit configured to circulate a cooling fluid through the inlet manifold, the first radiator core, the second radiator core, the outlet manifold, and the internal combustion engine;
a first valve positioned on the cooling fluid circuit to control a flow of the cooling fluid through the first radiator core, wherein the first valve can be:
opened to allow for parallel flow of the cooling fluid through the first radiator core and the second radiator core between the inlet manifold and the outlet manifold; and
closed to interrupt the flow of the cooling fluid through the first radiator core between the inlet manifold and the outlet manifold;
a controller; and
a memory device including:
threshold ambient air temperatures correlated to reference ambient air temperatures, wherein differences between operating temperatures of the cooling fluid of the internal combustion engine and the reference ambient air temperatures lead to thermal fatigue cracking in the first radiator core or the second radiator core; and instructions that, when executed by the controller, cause the first valve to open or close to reduce thermal fatigue and associated cracking induced in the first radiator core or the second radiator core caused by ambient air temperatures below the threshold ambient air temperatures.

17. The radiator system of claim 16, further comprising an ambient air temperature sensor, wherein the memory device includes instructions to compare a sensed ambient air temperature to at least one of the threshold ambient air temperatures.

18. The radiator system of claim 17, wherein ambient air temperature sensor readings from the ambient air temperature sensor to compare to the at least one threshold ambient air temperature are obtained before the internal combustion engine is started.

19. The radiator system of claim 17, wherein the instructions cause the first valve to alternatively open and close based on the sensed ambient air temperature to distribute thermal fatigue between the first radiator core and the second radiator core.

20. The radiator system of claim 17, wherein the instructions cause the first valve or a second valve positioned on the cooling fluid circuit to open or close based on the sensed ambient air temperature to concentrate thermal fatigue in the first radiator core or the second radiator core.

* * * * *